US010185273B2

(12) United States Patent
Adaniya

(10) Patent No.: US 10,185,273 B2
(45) Date of Patent: Jan. 22, 2019

(54) SHEET CONVEYANCE GUIDE UNIT, AND A SHEET CONVEYING APPARATUS AND AN IMAGE FORMING APPARATUS THEREWITH

(71) Applicant: CANON KABUSHIKI KAISHA, Tokyo (JP)

(72) Inventor: Makoto Adaniya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/403,340

(22) Filed: Jan. 11, 2017

(65) Prior Publication Data

US 2017/0205749 A1 Jul. 20, 2017

(30) Foreign Application Priority Data

Jan. 18, 2016 (JP) ..... 2016-006786

(51) Int. Cl.

| | |
|---|---|
| ***B65H 5/36*** | (2006.01) |
| ***G03G 15/00*** | (2006.01) |
| ***B65H 5/38*** | (2006.01) |
| ***B65H 29/52*** | (2006.01) |

(Continued)

(52) U.S. Cl.

CPC ..... *G03G 15/6529* (2013.01); *B65H 5/36* (2013.01); *B65H 5/38* (2013.01); *B65H 29/52* (2013.01); *B65H 85/00* (2013.01); *G03G 15/234* (2013.01); *B65H 2301/33312* (2013.01); *B65H 2301/5133* (2013.01); *B65H 2402/80* (2013.01); *B65H 2404/5311* (2013.01); *B65H 2404/5331* (2013.01); *B65H 2515/716* (2013.01); *B65H 2801/06* (2013.01); *G03G 2215/00675* (2013.01)

(58) Field of Classification Search

CPC .... B65H 5/36; B65H 5/38; B65H 2301/3121; B65H 2301/5133; B65H 2401/21; B65H 2401/211; B65H 2404/533; B65H 2404/5331; B65H 2515/716

See application file for complete search history.

(56) References Cited

U.S. PATENT DOCUMENTS

| | | | |
|---|---|---|---|
| 6,775,515 | B2 | 8/2004 | Ouchi |
| 7,110,148 | B2 | 9/2006 | Hasegawa et al. |
| 7,665,837 | B2 | 2/2010 | Son |

(Continued)

FOREIGN PATENT DOCUMENTS

| | | | |
|---|---|---|---|
| CN | 1365230 | A | 8/2002 |
| CN | 1483591 | A | 3/2004 |

(Continued)

OTHER PUBLICATIONS

Nov. 1, 2018 Chinese Official Action in Chinese Patent Appln. No. 201710023063.2.

*Primary Examiner* — Jeremy R Severson
(74) *Attorney, Agent, or Firm* — Venable LLP

(57) ABSTRACT

Disclosed is a sheet conveyance guide unit. The sheet conveyance guide unit includes a first sheet guide member which is of a sheet-like shape and which guides a sheet on which an image is formed and a second sheet guide member which is of a sheet-like shape and which is attached on a sheet guide surface of the first sheet guide member. A length of the second sheet guide member in a direction which crosses a sheet conveying direction is smaller than that of the first sheet guide member.

19 Claims, 14 Drawing Sheets

(51) Int. Cl.
*B65H 85/00* (2006.01)
*G03G 15/23* (2006.01)

(56) References Cited

U.S. PATENT DOCUMENTS

| | | | | |
|---|---|---|---|---|
| 7,680,449 | B2 * | 3/2010 | Shimizu | B65H 5/38 399/397 |
| 7,715,757 | B2 | 5/2010 | Tanaka et al. | |
| 8,855,544 | B2 * | 10/2014 | Namisaki | G03G 15/2028 399/397 |
| 9,557,688 | B2 * | 1/2017 | Tajiri | G03G 15/00 |
| 2002/0105686 | A1 | 8/2002 | Hasegawa et al. | |
| 2004/0052561 | A1 | 3/2004 | Ouchi | |
| 2007/0085892 | A1 | 4/2007 | Son | |
| 2008/0075503 | A1 | 3/2008 | Tanaka et al. | |

FOREIGN PATENT DOCUMENTS

| | | | |
|---|---|---|---|
| CN | 1948108 | A | 4/2007 |
| CN | 101154062 | A | 4/2008 |
| JP | 2002-46920 | A | 2/2002 |

* cited by examiner

SHEET CONVEYANCE GUIDE UNIT, AND A SHEET CONVEYING APPARATUS AND AN IMAGE FORMING APPARATUS THEREWITH

BACKGROUND OF THE INVENTION

Field of the Invention

The present invention relates to a sheet conveyance guide unit which guides a conveyed sheet in order to smoothly convey a sheet, and further relates to a sheet conveying apparatus and an image forming apparatus with the sheet conveyance guide unit, such as a copying machine, a printer and a facsimile.

Description of the Related Art

In an image forming apparatus such as a copying machine and a printer, a guide member which guides a conveyed recording sheet is often made from a plate-like member with rigidity such as a metal plate. However, recently, such a guide member is sometimes made of a sheet-like member with elasticity. In this case, the recording sheet sticks to the plate-like member by frictional electrification produced between the recording sheet and the sheet guide member, thereby inhibiting the proper conveyance of the recording sheet. Further, it is known that a toner image which has not been fixed is disturbed by such frictional electrification.

When a sheet-like guide member is employed, usage of a conductive sheet is proposed in order to eliminate the influence of the frictional electrification as disclosed in Japanese Patent Application Publication No. 2002-46920.

However, in the apparatus of Japanese Patent Application Publication No. 2002-46920, since the sheet-like guide member follows the recording sheet and is always in contact with the recording sheet, the sheet-like guide member is electrically charged by friction. Due to an electrostatic force of the friction, the recording sheet sticks more firmly to the sheet-like guide member, thereby generating a greater friction force and increasing a sheet passing resistance.

Because of this problem, when employing a sheet-like guide member, a relatively small sheet-like guide member is partially used.

SUMMARY OF THE INVENTION

The present invention reduces a conveying resistance between a conveyed sheet and the guide member which guides the conveyed sheet so that a large sheet-like guide member can be used.

A sheet conveyance guide unit according to the present invention, comprises: a first sheet guide member which is of a sheet-like shape and which guides a sheet on which an image is formed; and a second sheet guide member which is of a sheet-like shape and which is attached on a sheet guide surface of the first sheet guide member, wherein a length of the second sheet guide member in a direction which crosses a sheet conveying direction is smaller than that of the first sheet guide member.

By reducing a conveying resistance of a sheet, when guiding a sheet conveyed by a large sheet-like guide member, a guide member which has a large surface can be used.

Further features of the present invention will become apparent from the following description of exemplary embodiments with reference to the attached drawings.

DESCRIPTION OF THE EMBODIMENTS

Hereinafter, the description will be made in detail to exemplary embodiments in which a sheet conveyance guide unit according to the present invention is applied to a printer.

First Embodiment

<Overall configuration of the image forming apparatus> First, the overall configuration of a printer as the image forming apparatus having a sheet conveying apparatus according to an embodiment of the present invention will be explained in brief.

Figure 1:
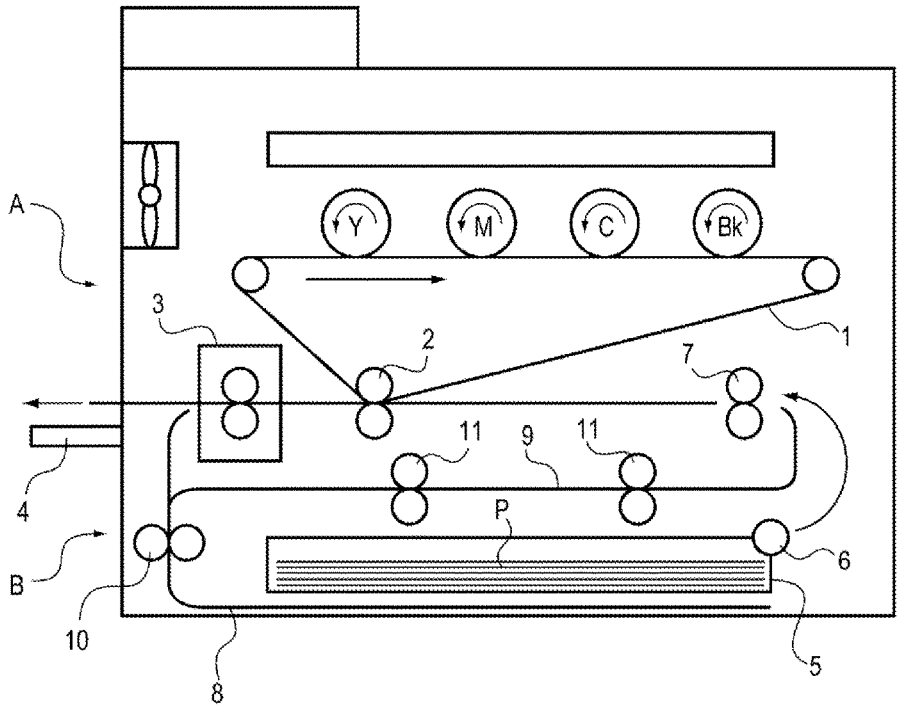
FIG. 1 is a diagram of a schematic cross-sectional view of an image forming apparatus.

FIG. 1 is a diagram for explaining the overall configuration of the image forming apparatus. The image forming apparatus A according to this embodiment has the first to fourth image forming units for forming a color image. The yellow image forming unit Y, the magenta image forming unit M, the cyan image forming unit C and the black image forming unit Bk are arranged in this order of image formation so that an image having a respective color is formed at each image forming unit.

Each image forming unit has a configuration identical with those of the other image forming units except for the color of an image to be formed. In this embodiment, the image forming units employ an electro-photographic system which is well-known. This system will be explained briefly. In each image forming unit, a latent image is formed on the surface of the photosensitive drum which is charged uniformly by exposing the surface to light corresponding to an image signal. The latent image is visualized by developing it with toner. The toner images of the respective colors of yellow, magenta, cyan and black which have been formed in image forming units are superimposed and primarily transferred on the intermediate transfer belt 1 to form a color image.

Synchronized with the formation of the color image, the recording sheet is conveyed to the secondary transfer portion 2 by the sheet conveying apparatus B where the color toner image on the intermediate transfer belt 1 is transferred to the recording sheet. This recording sheet is conveyed to the fixing portion 3 where the toner image is fixed by heating and pressuring. The recording sheet having the fixed image is discharged to the discharging portion 4.

<Sheet Conveying Apparatus> The sheet conveying apparatus B conveys the recording sheet P accommodated in the sheet cassette 5 to the secondary transfer portion 2 and conveys also the recording sheet on which a toner image is transferred from the fixing portion 3 to the discharging portion 4. For this purpose, the sheet conveying apparatus B has a conveying portion which includes the feeding roller 6 and the conveying roller 7 and so on for conveying the recording sheet P and a sheet conveyance guide unit and so on for guiding the conveyed recording sheet P.

In the sheet conveying apparatus B according to this embodiment, image forming is made possible on both surfaces of the recording sheet P. For this purpose, the sheet conveying apparatus B has the reverse conveying path 8 for reversely conveying the sheet on the first surface of which an image is formed and the resending path 9 for reversing the conveying direction of the recording sheet which has entered the reverse conveying path 8 by switchback and for conveying the recording sheet again to the secondary transfer portion 2. When recording is done on both surfaces, the recording sheet on the first surface of which an image has been formed is conveyed to the reverse conveying path 8 by the conveying roller 10 without discharging the recording sheet to the discharging portion 4. When the trailing edge of the recording sheet arrives at a predetermined position, the recording sheet is reversely conveyed to the resending path 9 by reversely driving the conveying roller 10. Then, the recording sheet is conveyed again to the secondary transfer portion 2 by the conveying roller 11 and so on where an image is formed on the second side of the recording sheet. After that, the recording sheet is discharged to the discharging portion 4.

<Sheet conveyance guide unit> On the reverse conveying path 8 for a recording sheet in the sheet conveying apparatus B according to this embodiment, the sheet conveyance guide unit C made of a sheet-like member is provided. Next, an explanation will be made to the sheet conveyance guide unit C in reference to the FIGS. 2 to 5.

Figure 2:
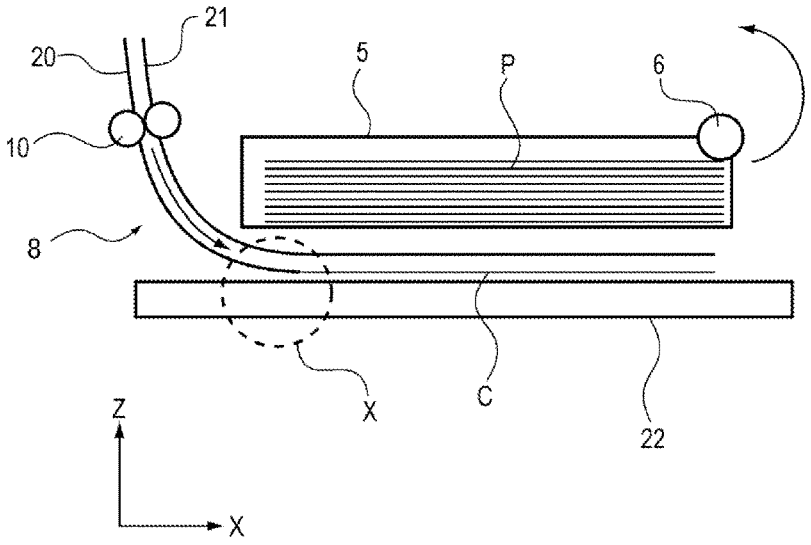
FIG. 2 is an explanatory diagram of a reverse conveying path.

FIG. 2 is a schematic diagram showing a sectional view of a reverse conveying path. As shown in FIG. 2, the reverse conveying path 8 has the lower conveying guide 20 which guides the lower surface of the recording sheet P and the upper conveying guide 21 to form a curved conveying path. The recording sheet is conveyed between the both guides 21 and 21. The both of the lower conveying guide 20 and the upper conveying guide 21 are made of metal member such as a metal plate.

Since it is necessary for the reverse conveying path 8 to have a large space for enabling the reversing of a recording sheet which is as large as possible, the reverse conveying path 8 according to this embodiment continues to the space between the sheet cassette 5 and the bottom plate 22 of the housing frame of the image forming apparatus. The upper conveying guide 21 extends along the bottom plate 22 to the space under the sheet cassette 5. The lower conveying guide 20 extends to the bottom plate 22 and the sheet conveyance guide unit C is attached to the downstream end of the lower conveying guide 20 in the sheet conveying direction. The sheet conveyance guide unit C is arranged in the space under the sheet cassette 5 such that the sheet conveyance guide unit C is opposed to the upper conveying guide 21 along the bottom plate 22. Accordingly, the lower surface of the recording sheet P conveyed to the reverse conveying path 8 is guided by the lower conveying guide 20 and as the recording sheet P advances in the reverse conveying path 8, the lower surface of the recording sheet P is guided by the sheet conveyance guide unit C.

Since the surface of the recording sheet P conveyed in the reverse conveying path, on which an image is formed, faces downwardly, the guide member provided at lower side of the reverse conveying path 8 is required to have surface property not to damage a toner image. As a processing method for having such surface property, a buffing process, PTFE coating and the like are used. However, when the bottom plate 22 has a function to work as a strengthening member for the housing frame and has the surface property not to damage a toner image, the bottom plate 22 becomes costly. Further, the lower conveying guide 20 is required to have rigidity since it is formed as a curved path thereby limiting material for the lower conveying guide 20.

Therefore, in this embodiment, the sheet conveyance guide unit C having surface property not to damage a toner image is attached to the downstream end of the lower conveying guide 20. The lower surface of the recording sheet P is guided by the sheet conveyance guide unit C.

Figure 3:
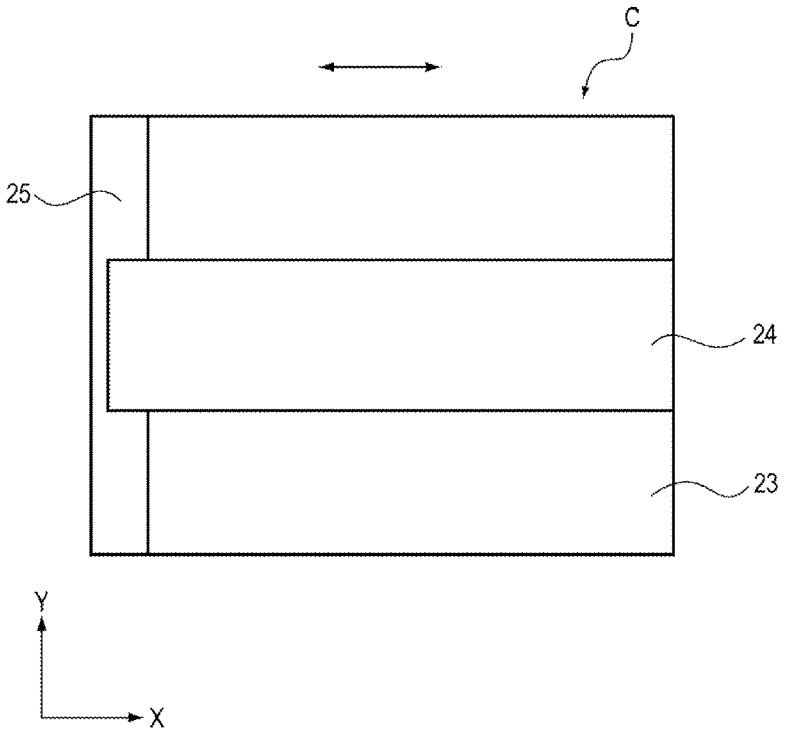
FIG. 3 is a diagram showing an explanatory plan view of a sheet conveyance guide unit.
Figure 4:
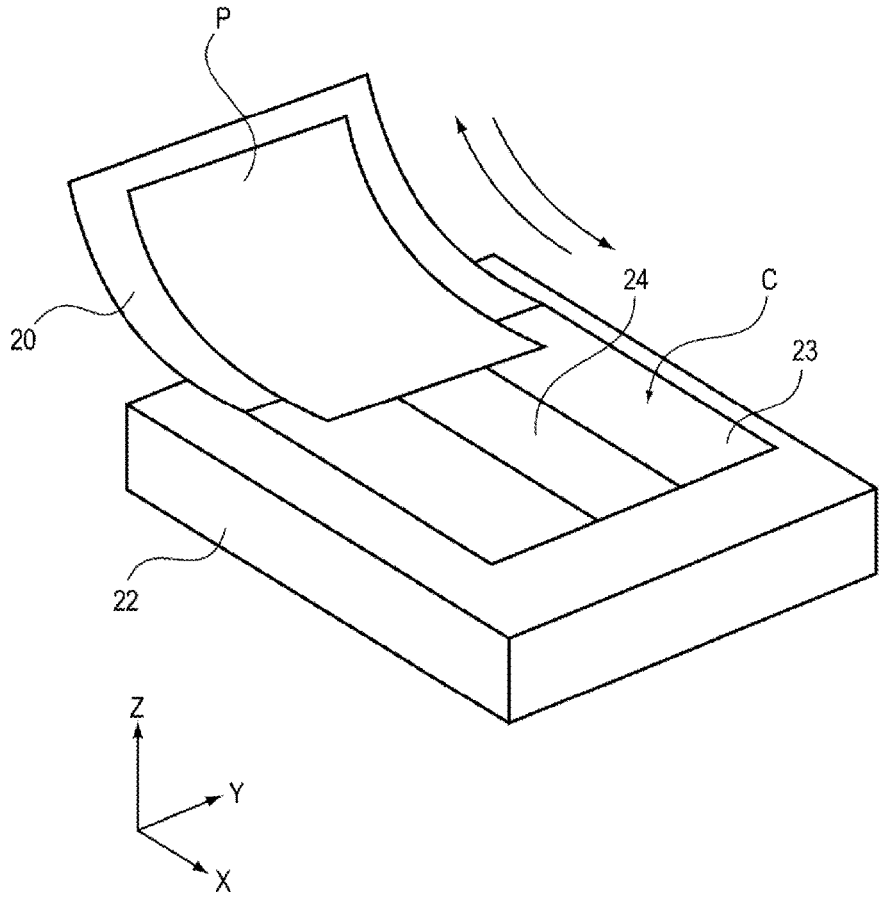
FIG. 4 is a diagram showing an explanatory perspective view of the reverse conveying path.
Figure 5:
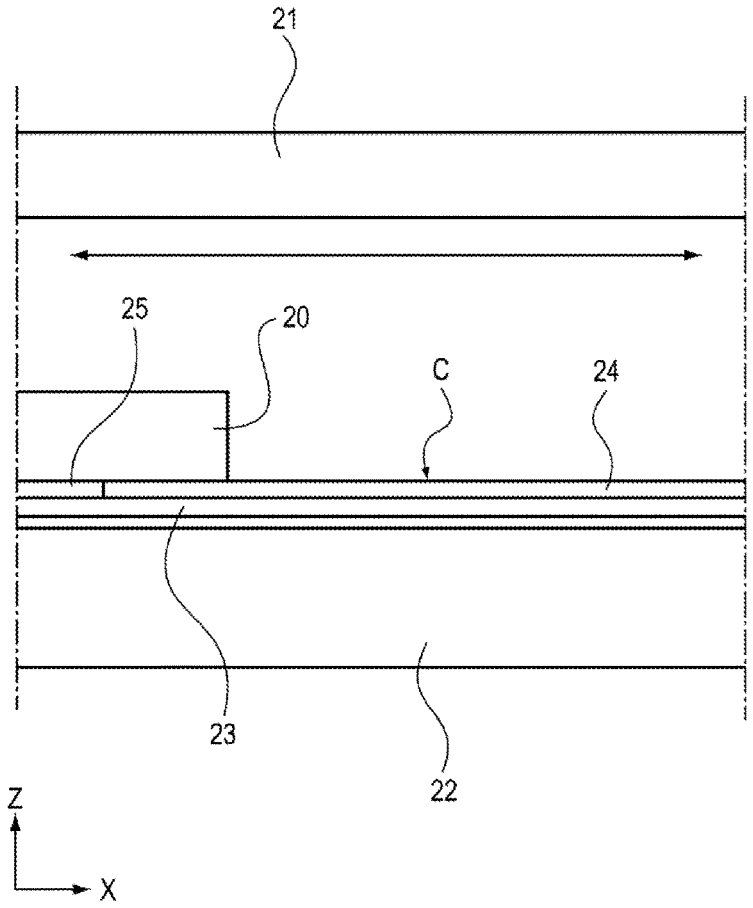
FIG. 5 is a diagram showing an explanatory cross-sectional view of the reverse conveying path.

As shown in FIGS. 3 to 5, the sheet conveyance guide unit C has the first sheet guide member 23 made of a resin sheet and the second sheet guide 24 also made of a resin sheet, which is pasted on the recording sheet conveyance guide surface (sheet guide surface) of the first sheet guide member 23. At the upstream end of the first sheet guide member 23, the pasting portion 25 for pasting the first sheet guide member 23 to the lower conveying guide 20 is provided. The pasting portion 25 is made from double-coated adhesive tape and so on. FIG. 3 is a diagram showing an explanatory plan view of the sheet conveyance guide unit C. FIG. 4 is a diagram showing an explanatory perspective view of the sheet conveyance guide unit C. FIG. 5 is a diagram showing an enlarged view of the portion X of FIG. 2.

The first sheet guide member 23 has a large enough size for guiding the lower surface of the largest conveyable recording sheet and is arranged above the bottom plate 22 in the reverse conveying path 8. Namely, the first sheet guide member 23 is arranged below the lower surface (the surface on which a toner image is formed) of the recording sheet P in the direction of gravity.

The second sheet guide member 24 is of an elongated shape and the length of second sheet guide member 24 in the direction crossing the conveying direction of the recording sheet is shorter than that of the first sheet guide member 23. The second sheet guide member 24 is made from material which has a better sliding property against the recording sheet than that of the lower conveying guide 20 or the first sheet guide member 23. In this embodiment, as shown in FIG. 3, at the center of the first sheet guide member 23 in the width direction (direction perpendicular to the conveying direction of the recording sheet), the second sheet guide member 24 is pasted.

The materials having good sliding property include those on which fluorine coating is performed and ultrahigh molecular weight polyethylene. Although, these materials are relatively expensive, when they are used only for the elongated second sheet guide member 24, the quantity of these materials are limited and a conveyance guide with a high sliding property can be obtained in low cost.

Since the elongated second sheet guide member 24 is pasted on the first sheet guide member 23, irregularities are produced on the conveying guide surface. Thus, the second sheet guide member 24 becomes actively in contact with the recording sheet P and the first sheet guide member 23 does not become in contact with the recording sheet P by that amount. Accordingly, the contact surface between the first sheet guide member 23 and the recording sheet P reduces, thereby reducing the conveying resistance and suppressing the generation of static electricity.

The second sheet guide member 24 of this embodiment is made from material having conductivity. The second sheet guide member 24 is provided so as to be in contact with the lower conveyance guide 20 made of metal (material having conductivity). As explained earlier, static electricity is generated on the sheet guide members by rubbing between the sheet guide members and the recording sheet P. In this embodiment, the second sheet guide member 24 which becomes in more contact with the recording sheet P is made of material having conductivity, enabling to eliminate via the lower conveyance guide 20 static electricity produced by rubbing, thereby suppressing sticking caused by frictional electrification. In order to impart conductivity to the second sheet guide member 24 made from a resin sheet, metal or carbon is blended with the resin sheet material for example.

The second sheet guide member 24 is pasted on the first sheet guide member 23, causing the portion in which both sheets overlap to increase thickness, thereby increasing the geometrical moment of inertia and increasing the strength. Namely, the second sheet guide member 24 is additionally laminated on the first sheet guide member 23, which plays a role of a strengthening member, thereby giving stiffness to the sheet members even if they are thin. During the conveying of the recording sheet, the electrostatic force is generated caused by frictional electrification. Due to this electrostatic force, the sheet guide members are elastically deformed and the sheet guides tend to stick to the recording sheet P. When the sheet members have stiffness, this electrostatic force can be overcome and the sheet guide does not tend to follow the recording sheet P. As a result, the contact resistance against the recording sheet P is reduced.

In this embodiment, the second sheet guide member 24 is made of material which has a higher conductivity and a higher sliding property than those of the first sheet guide member 23. However, even if the second sheet guide member 24 is made of the same material as the first sheet guide member 23, the effect of increasing strength can be achieved because thickness increases in the overlapping portion of both the first sheet guide member 23 and the second sheet guide member 24 and the geometrical moment of inertia increases.

In the previous example, the single second sheet guide member 24 is pasted on the first sheet guide member 23. However, as shown in FIGS. 6 and 7, a plurality of second sheet guide members 24 can be pasted on the first sheet guide member 23.

By pasting a plurality of elongated second sheet guide members 24 in parallel with the direction of conveying the recording sheet, the portion with which the recording sheet is in contact can be divided. More air layers are created between the recording sheet P and the sheet conveyance guide unit C because a number of irregularities made with the first sheet guide member 23 and the second sheet guide member 24 increase. Accordingly, a higher sliding property can be achieved than the case where a single second sheet guide member 24 is pasted.

Figure 6:
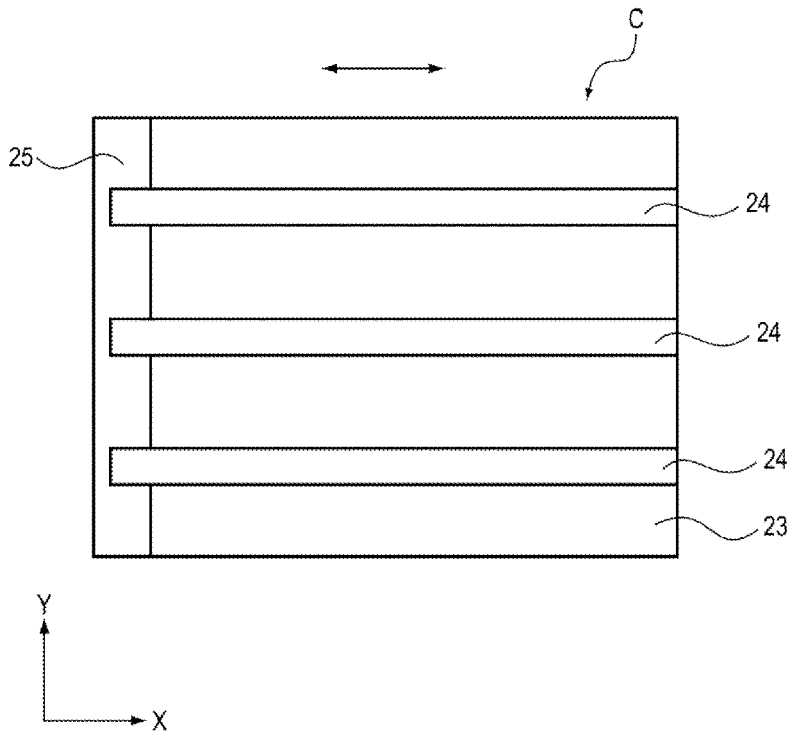
FIG. 6 is a diagram showing an explanatory plan view of a sheet conveyance guide unit in which a plurality of second sheet guide members are arranged.
Figure 7:
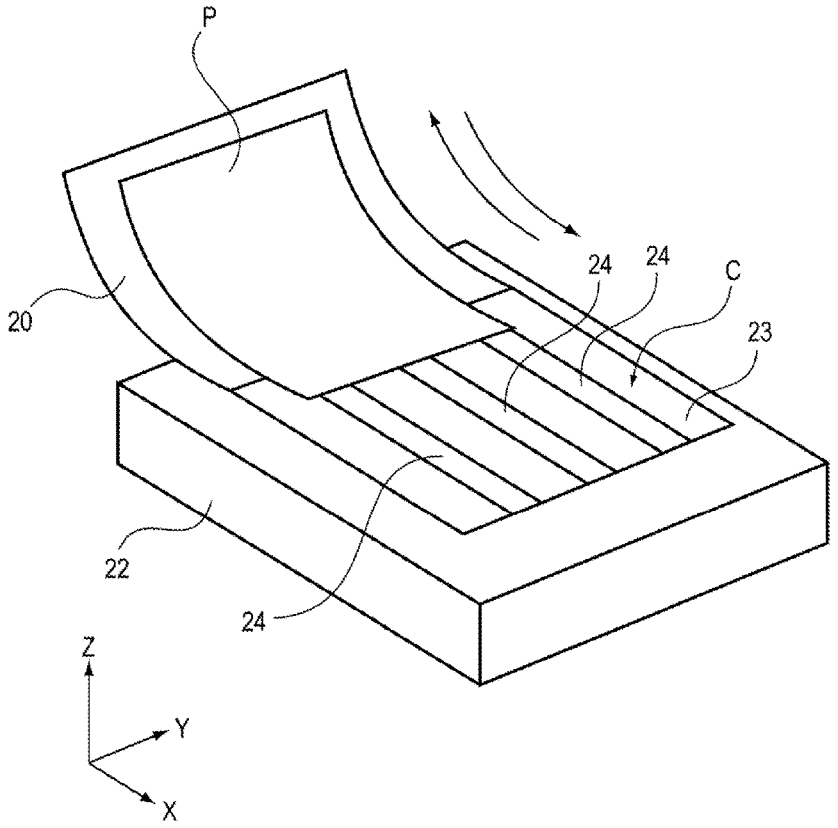
FIG. 7 is a diagram showing an explanatory perspective view of a reverse conveying path using the sheet conveyance guide unit in which a plurality of second sheet guide members are arranged.

In the example of FIGS. 6 and 7, three second sheet guide members 24 are pasted. The more the second sheet guide members 24 are provided, the higher the conveying property becomes. When providing a plurality of second sheet guide members 24, thickness partially increases as compared with the case where the single second sheet guide member 24 is provided and the geometrical moment of inertia increases, thereby achieving a higher strength.

Although the sheet conveyance guide unit C is provided on the reverse conveying path 8 in this embodiment, it can be provided on other conveying paths such as those in the sheet feeding portion.

Second Embodiment

In the previous embodiment indicated in FIGS. 6 and 7, a plurality of second sheet guide members 24 are pasted in parallel with the direction of conveying the recording sheet.

Figure 8:
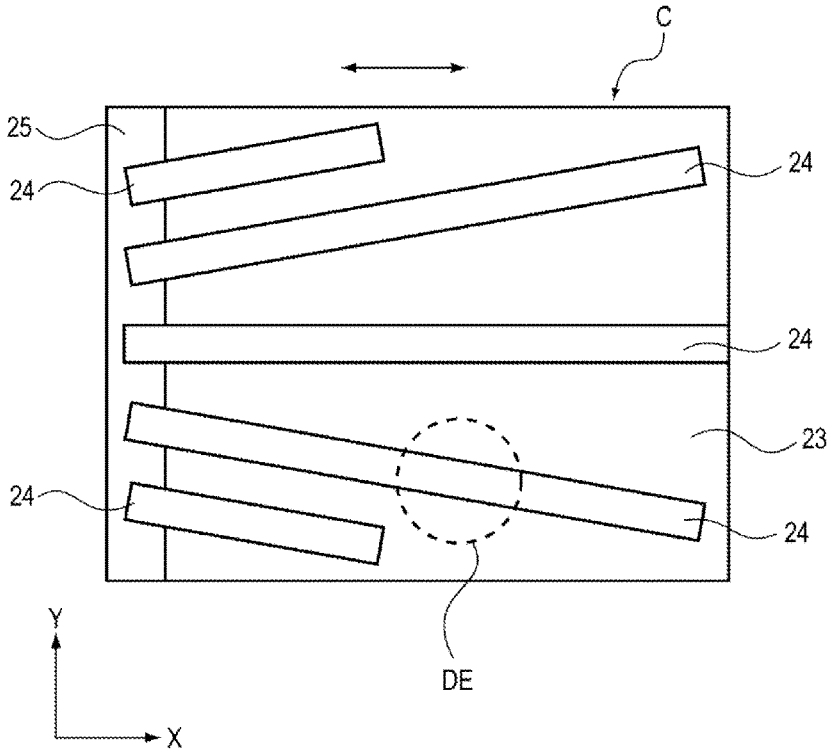
FIG. 8 is a diagram showing an explanatory plan view of a sheet conveyance guide unit in which a plurality of second sheet guide members are radially arranged.
Figure 9:
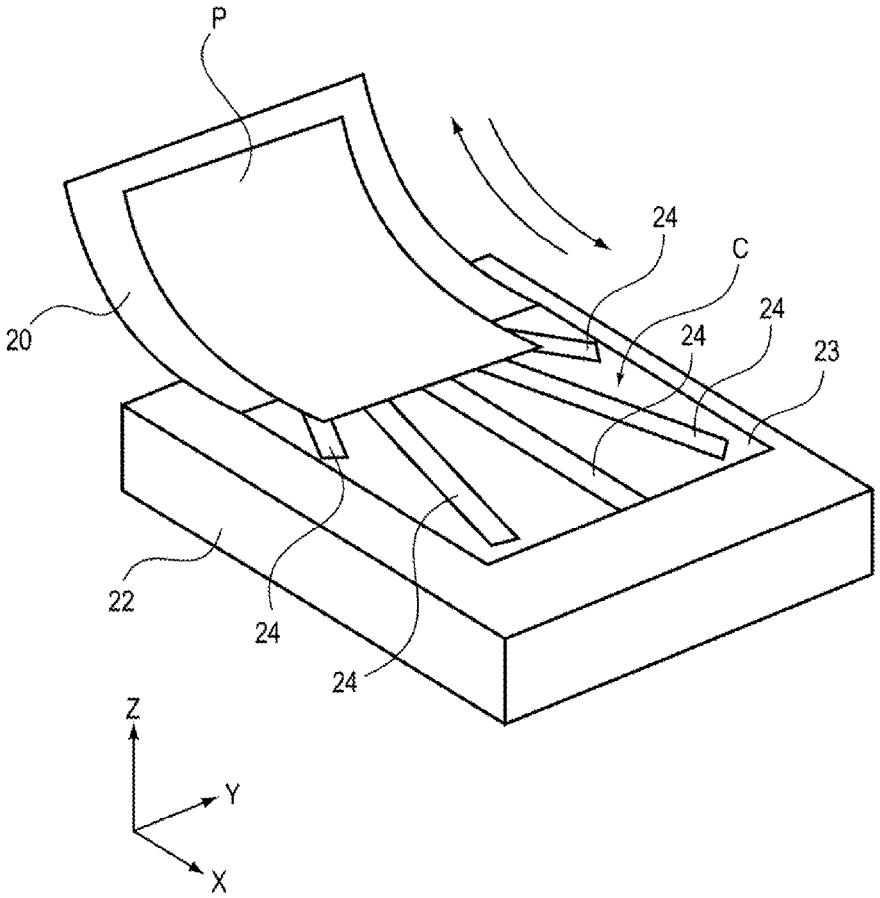
FIG. 9 is a diagram showing an explanatory perspective view of a reverse conveying path using the sheet conveyance guide unit in which a plurality of second sheet guide members are radially arranged.

FIGS. 8 and 9 show the example in which a plurality of second sheet guide members 24 are pasted such that the long edges of the second sheet guide members 24 have angles with respect to the direction of conveying the recording sheet. In this embodiment, as shown in these figures, a plurality of elongated second sheet guide members 24 are radially arranged on the first sheet guide member 23 such that the elongated second sheet guide members 24 are spread in the downstream direction of conveyance.

When the long edges of a plurality of second sheet guide members 24 are arranged in parallel with the direction of conveying the recording sheet, i.e., without an angle with respect to the conveying direction as shown in FIGS. 6 and 7, the portion of the conveyed recording sheet which is always in contact with the second sheet guide member 24 is adjacent to the portion of the conveyed recording sheet which is always not in contact with the second sheet guide member 24. Thus, the toner image which has been transferred on the recording sheet includes the part which is always in contact with the second sheet guide member 24 and the part which is always not in contact with the second sheet guide member 24 so that the contact unevenness can be easily seen.

In contrast to that, when the second sheet guide members 24 are pasted with angles with respect to the direction of conveying the recording sheet as in this embodiment, the contact unevenness is less noticeable because the part which is in contact with the second sheet guide member 24 moves. Further, by radially arranging the second sheet guide members 24, the curving of the sheet conveyance guide unit C can be suppressed because the cross-sectional area of the portion on which the second sheet guide member 24 is pasted increases and the strength increases.

When the second sheet guide member 24 is pasted on the first sheet guide member 23 with the long edge of the second sheet guide member 24 having an angle with respect to the direction of conveying the recording sheet as explained above, a reference for pasting is necessary. Accordingly, in this embodiment, a plurality of small holes are provided as a reference for pasting the second sheet guide member 24 on the first sheet guide member 23.

Figure 10:
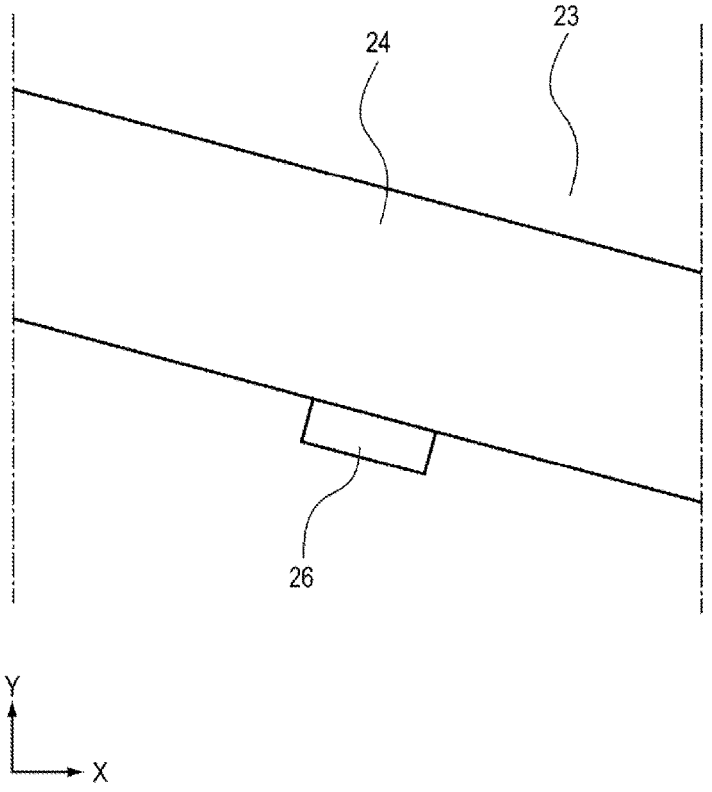
FIG. 10 is an explanatory diagram of a hole as a reference for attaching a second conveyance guide member.

FIG. 10 is a DE partial enlarged view of FIG. 8. The hole 26 is provided on the first sheet guide member 23 and the second sheet guide 24 is pasted with reference to the hole 26. In this embodiment, the hole 26 of 2 mm×5 mm is radially provided with the pitch of 100 mm. The second sheet guide member 24 is arranged and pasted such that an end portion on a long edge of the second sheet guide member 24 corresponds to the hole 26. The end portion of the second sheet guide member 24 to correspond to the hole 26 is an end portion of the second sheet guide member 24 in the width direction of the recording sheet (the direction perpendicular to the direction of conveying the recording sheet), i.e., an outside end portion with respect to the center of sheet conveyance.

When the hole 26 is formed by punching, the direction of a burr caused by punching is made downward in the main body so that the burr does not face the conveying surface for the purpose of preventing the conveyed recording sheet from being caught by the burr.

The reason why the positional relationship between the second sheet guide member 24 and the hole 26 is made as described above will be explained with reference to the FIGS. 11 to 14.

Figure 11:
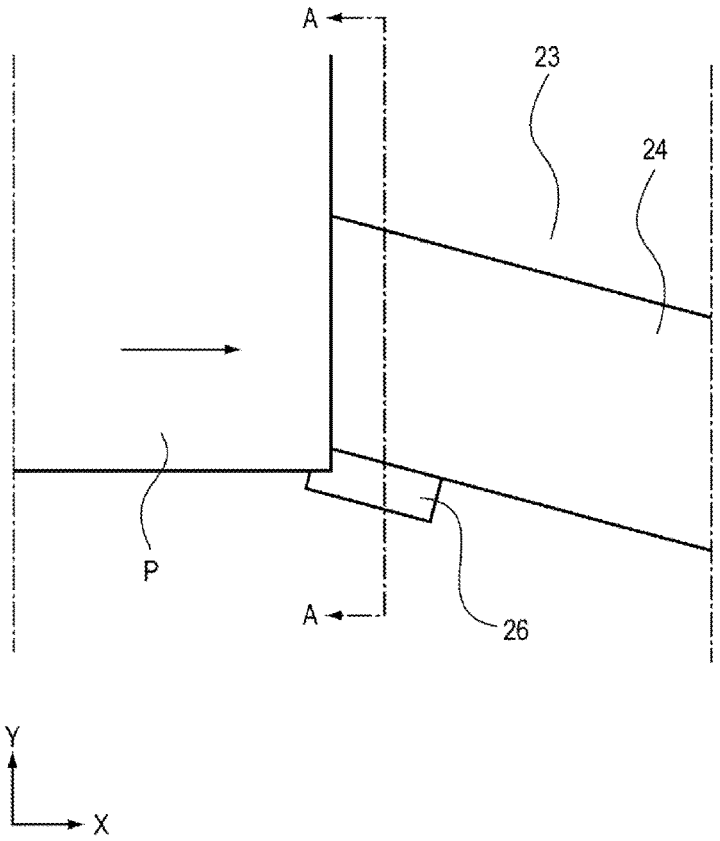
FIG. 11 is a diagram showing an explanatory plan view of the case where the reference hole is arranged on an outer side end of the second sheet guide member.
Figure 12:
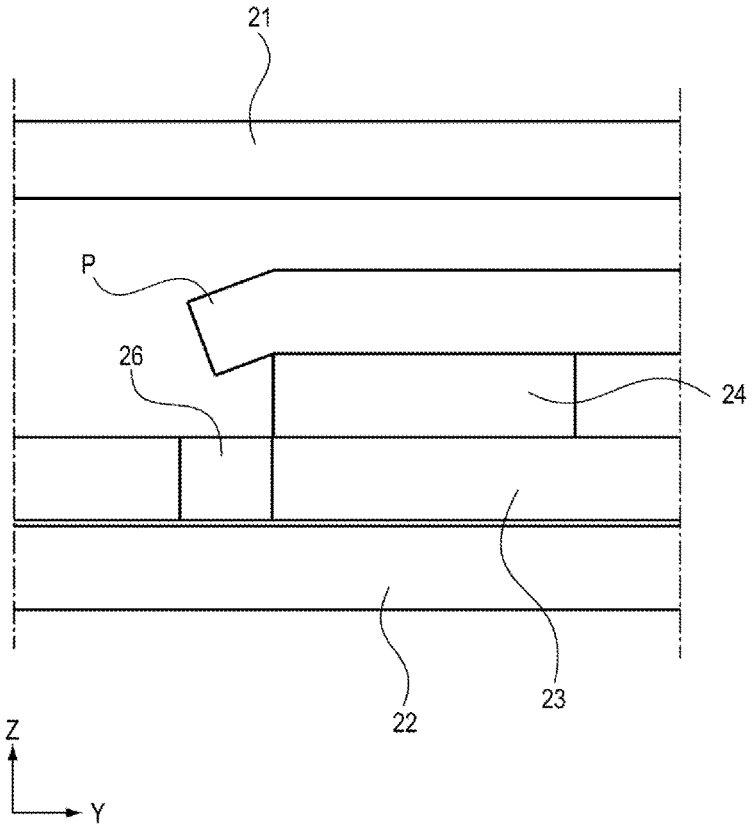
FIG. 12 is a diagram showing an A-A cross-sectional view of FIG. 11.

FIG. 11 shows the state in which an end portion of the recording sheet P conveyed in the direction X reaches the hole 26 in the configuration in which an outer end portion of the second sheet guide member 24 with respect to the center of recording sheet conveyance should correspond to the hole 26 as in this embodiment. FIG. 12 is an A-A cross-sectional view of FIG. 11 in this case. The first sheet guide member 23 is arranged on the bottom plate 22 as a supporting member and the second sheet guide member 24 is pasted on the first sheet guide member 23.

The recording sheet P is placed on the second sheet guide member 24 and an end portion of the second sheet guide member 24 hangs out of the second sheet guide member 24. The hole 26 as a reference for pasting the second sheet guide member 24 is arranged at an outside from the center of recording sheet conveyance in the direction Y in the figures. In this state, an end portion of the recording sheet P is placed such that the end portion reaches the hole 26. However, the end portion does not fall in the hole 26 formed on the first sheet guide member 23 because the recording sheet P is conveyed on the second sheet guide member 24 and the recording sheet P is apart from the hole 26 by the thickness of the second sheet guide member 24.

Figure 13:
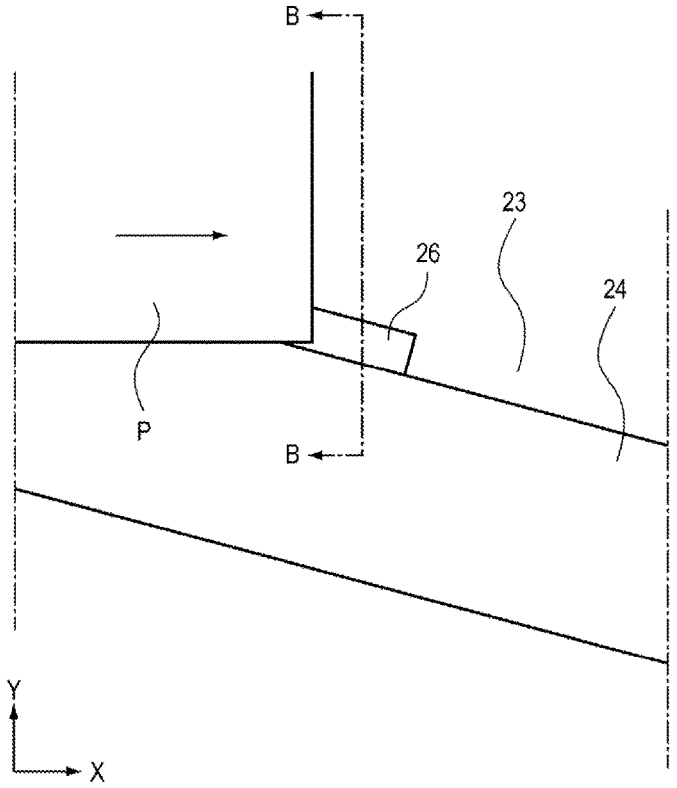
FIG. 13 is a diagram showing an explanatory plan view of the case where the reference hole is arranged on an inner side end of the second sheet guide member.
Figure 14:
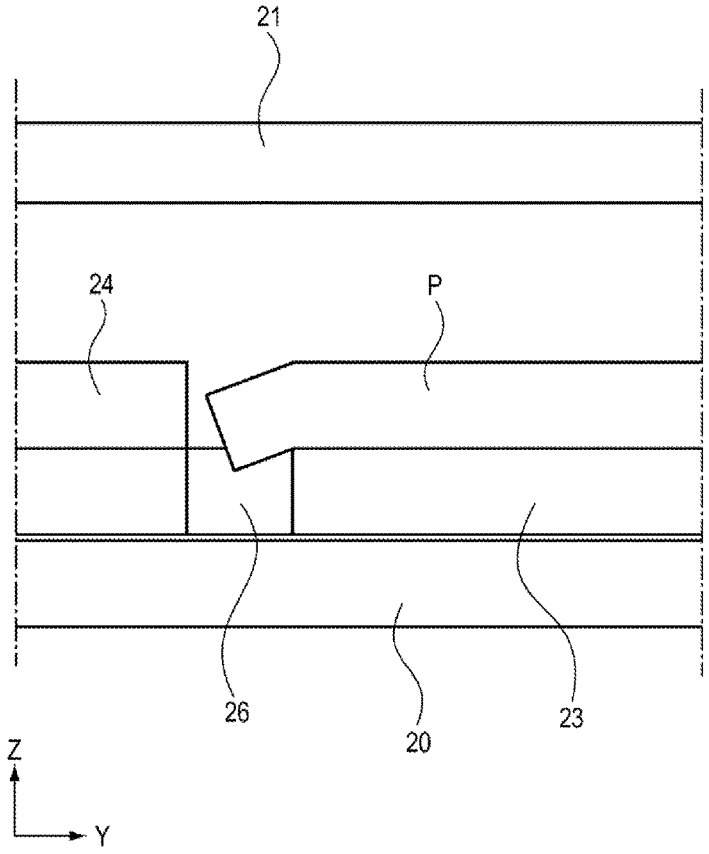
FIG. 14 is a diagram showing a B-B cross-sectional view of FIG. 13.

On the other hand, FIG. 13 shows the state in which an end portion of the recording sheet P conveyed in the direction X reaches the hole 26 in the configuration in which an inner end portion of the second sheet guide member 24 with respect to the center of the recording sheet conveyance should correspond to the hole 26. FIG. 14 is a B-B cross-sectional view of the FIG. 13 in this case.

The recording sheet P is conveyed on the first sheet guide member 23 and an end portion of the recording sheet P is placed above the hole 26. In this case, the end portion of the recording sheet P easily falls in the hole 26. When the end portion of the recording sheet P falls in the hole, it might be possible that the recording sheet P cannot be conveyed because a corner of the recording sheet P is folded or because the recording sheet P is caught by the hole 26.

Accordingly, when the hole 26 as a reference for pasting the second sheet guide member 24 on the first sheet guide member 23 should be provided, it is better to arrange the second sheet guide member 24 such that an outer end portion of the second sheet guide member 24 with respect to the center of the recording sheet conveyance corresponds to the position of the hole 26.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2016-006786, filed Jan. 18, 2016, which is hereby incorporated by reference herein in its entirety.

What is claimed is:

1. A sheet conveyance apparatus comprising:

a conveying unit configured to convey a sheet on which an image is formed;

a first resin sheet configured to guide the sheet conveyed by the conveying unit; and a second resin sheet that is attached on the first resin sheet and configured to guide the sheet, wherein a surface of the second resin sheet contacts with the sheet having been conveyed, and wherein a length of the second resin sheet in a direction which crosses a sheet conveying direction is shorter than that of the first resin sheet.

2. The sheet conveyance apparatus according to claim 1, further comprising a guide member configured to guide the sheet conveyed by the conveying unit, wherein the first and second resin sheets are disposed downstream of the guide member in the sheet conveying direction, and wherein the second resin sheet has an electrical conductivity and is in contact with the guide member which has an electrical conductivity.

3. The sheet conveyance apparatus according to claim 1, wherein the second resin sheet has a higher sliding property for a conveyed sheet than that of the first resin sheet.

4. The sheet conveyance apparatus according to claim 1, wherein the second resin sheet is attached such that a long edge of the second resin sheet is inclined in the sheet conveying direction.

5. The sheet conveyance apparatus according to claim 1, wherein a plurality of the second resin sheets are arranged on the first resin sheet.

6. The sheet conveyance apparatus according to claim 1, wherein the plurality of second resin sheets are arranged in a direction that crosses the sheet conveying direction.

7. The sheet conveyance apparatus according to claim 6, wherein each of the plurality of second resin sheets is arranged in parallel with the sheet conveying direction.

8. The sheet conveyance apparatus according to claim 6, wherein at least one of the plurality of second resin sheets is radially spread downstream in the sheet conveying direction.

9. The sheet conveyance apparatus according to claim 1, wherein a hole is formed on the first resin sheet as a reference for attaching the second resin sheet.

10. The sheet conveyance apparatus according to claim 9, wherein the hole is used as a reference for positioning an end portion on a long edge of the second resin sheet in a direction perpendicular to the sheet conveying direction.

11. The sheet conveyance apparatus according to claim 9, wherein the hole is formed by punching from a sheet guide surface side of the first resin sheet.

12. The sheet conveyance apparatus according to claim 1, wherein the first sheet guide guides a surface of a sheet on which an image is formed.

13. The sheet conveyance apparatus according to claim 1, further comprising a supporting member that supports the first resin sheet from a side which is opposed to a sheet guide surface of the first resin sheet.

14. An image forming apparatus comprising:

an image forming portion which forms an image on a sheet;

a conveying unit configured to convey a sheet on which an image is formed;

a first resin sheet configured to guide the sheet conveyed by the conveying unit; and a second resin sheet that is attached on the first resin sheet and configured to guide the sheet, wherein a surface of the second resin sheet contacts with the sheet having been conveyed, and wherein a length of the second resin sheet in a direction which crosses a sheet conveying direction is shorter than that of the first resin sheet.

15. The image forming apparatus according to claim 14, further comprising a guide member configured to guide the sheet conveyed by the conveying unit, wherein the first and second resin sheets are disposed on downstream of the guide member in the sheet conveying direction, and wherein the second resin sheet has an electrical conductivity and is in contact with the guide member which has an electrical conductivity.

16. The image forming apparatus according to claim 14, wherein the second resin sheet has a higher sliding property for a conveyed sheet than that of the first resin sheet.

17. The image forming apparatus according to claim 14, wherein a plurality of resin sheets having a configuration of the second resin sheet are arranged on the first resin sheet.

18. The image forming apparatus according to claim 17, wherein the plurality of second resin sheets are arranged in a direction which crosses the sheet conveying direction.

19. The image forming apparatus according to claim 17, further comprising a supporting member which supports the first resin sheet from a side which is opposed to a sheet guide surface of the first resin sheet.

* * * * *